United States Patent [19]

Laib

[11] Patent Number: 4,796,554

[45] Date of Patent: Jan. 10, 1989

[54] SAILBOAT

[76] Inventor: Wilhelm Laib, Mozartstr. 28, D-7030 Boeblingen, Fed. Rep. of Germany

[21] Appl. No.: 38,691

[22] Filed: Apr. 15, 1987

[30] Foreign Application Priority Data

Apr. 16, 1986 [EP] European Pat. Off. ..... 86 105247

[51] Int. Cl.[4] ..... B63B 1/04; B63H 9/04

[52] U.S. Cl. ..... 114/39.1; 114/90; 114/103; 114/105

[58] Field of Search ..... 114/39.1, 56, 355, 356, 114/357, 358, 292, 102, 103, 90, 104, 105, 91

[56] References Cited

U.S. PATENT DOCUMENTS

| | | | |
|---|---|---|---|
| 4,193,366 | 3/1980 | Salminen | 114/39 |
| 4,386,574 | 6/1983 | Riolland | 114/103 |
| 4,561,374 | 12/1985 | Asber | 114/103 |
| 4,685,410 | 8/1987 | Fuller | 114/103 X |

FOREIGN PATENT DOCUMENTS

| | | | |
|---|---|---|---|
| 100101 | 10/1940 | Switzerland | 114/356 |
| 381830 | 10/1932 | United Kingdom | 114/90 |

*Primary Examiner*—Sherman D. Basinger

*Attorney, Agent, or Firm*—Shlesinger, Arkwright & Garvey

[57] ABSTRACT

The invention relates to a sailboat in which the hull is defined by cross-sections forming equilateral triangles standing on one tip with convex sides and which continuously decrease in size toward the bow and stern so that the keel line and the side edges coincide there and a substantially symmetrical ellipsoid is formed. The ellipsoid includes an extended bow cockpit and downwardly and outwardly slanting adjustable rudder vanes simultaneously forming rest feet. A central seat in the hull receives an adjustable mast of a profiled sail corresponding to a symmetrical airfoil profile having an adjustable airfoil cap at its front end. Several beams at the mast can be pulled up over each other and sail segments mounted in between can be reefed.

18 Claims, 4 Drawing Sheets

SAILBOAT

The invention concerns a sailboat with a predominantly closed hull and at least one mast resting on the hull. A sailboat in the sense of the invention is a wind-driven water vehicle with one or more masts and having a hull made of wood, glass-fiber reinforced plastic or metal.

The object of the invention is a sailboat of the above design having a hull of high strength, high positional stability and self-righting following overturning so as to achieve high seaworthiness, and furthermore with low flow resistance and optimal sailing properties, in particular when tacking relative to the wind.

In the basic concept of the invention, this problem is solved for a general embodiment mode in that the hull shape is determined by cross-sections forming in particular equilateral triangles which are upside down, having convex sides and further continuously decreasing towards bow and stern until down to approximately dot size, whereby the edge lines of the triangles containing the three corners intersect there and a body substantially symmetrical about its main axis and similar to an ellipsoid and having advantageous strength is generated. A rotatably supported edged mast which is part of a profiled sail showing in top view a symmetrical airfoil contour rests in a seat approximately at the center of the hull and bears at its front end a laterally adjustable foil cap.

The proposed cross-sectional shape of the hull as being an inverted triangle with the sides curving outward secures high strength and further advantageous positional stability. In combination with the hull shape and the weight distribution on the rudder the invention achieves self-righting after overturning, which ordinarily is not possible in spite of the centerboard in board and flat sailboats.

Seen from the side and from the top, the hull assumes an approximately elliptical shape, one end being extended by a mounted bow tip. The elliptical shape endows the hull with additional rigidity, and a center piece may be inserted to extend the hull. In a practical embodiment the hull is made of laminated mahogany wood, the laminations being bonded with epoxy resin and being cemented to prefinished sets of annular ribs. For mass production, hulls made of welded steel or light-alloy plates are used.

To assure stable sailing, the hull may be extended at the bow by a cockpit until its upper side will be about plane and flush with the upper lateral edges of the hull, while the hull keel edge continues smoothly up to the bow tip. Transparent and dome-shaped canopies may be provided at the bow and stern to close off spaces behind them.

A feature which where required may be made independent of the hull consists of a profiled sail of which the mast rests on an advantageous length in the hull of the sailboat of the invention. Preferably the mast is a triangular pipe though other cross-sections also are applicable. The mast is rotatable by means of a motor. The profile sail is the part supporting the mast and has a symmetrical airfoil contour with an adjustable foil cap at the front end to tack against the wind at the highest efficiency.

Several generally horizontal sail beams are kept in vertically displaceable manner on the rotatably mast and are mutually connected by sail segments which can be reefed sequentially from bottom to top in the manner of bellows between adjacent beams and the remaining sail segments each time can be displaced downward at the mast by the height of the reefed sail segment.

Appropriately the horizontal sail beams guided at the mast consist of rigid, metallic frame, with the top beam being drawn-up by cables into an uppermost position and with the lower beams each being connected by sail segments to the next higher beam. The height to which the top beam is drawn up therefore determines the height of the sail. Illustratively only one sail segment is drawn up, whereby only that sail segment which is located between the top beam and the next lower beam is exposed to the wind as the other sails are reefed. Such a setting may be suitable in high winds to manoeuver with a small sail surface close to the center of gravity of the boat.

Each sail beam, including the sail segment mounted to the next higher beam, corresponds to the airfoil profile, a cloth foil cap being mounted in hinging and adjustable manner at the rear section segment. Each foil cap consists of a front frame part pivotable about a central vertical axis at the airfoil profile.

The lowest sail beam can be designed in the manner of a trough and be provided at its underside with a fitting seating and closing off from about the rotatable mast passing through it and held in the boat deck, and housing furthermore the motor winch to pull up the sail beams.

In a further feature of the invention, plates may be provided parallel to the sail beams within the sail segments, which correspond to the airfoil profile and to the periphery of which the sail is mounted. The plates may be mutually connected or to the beam above or below by means of outwardly kinking toggle-joints in such a manner that the sail area fastened to the knees of the toggle-joints when in the reefed condition shall be moved outward relative to the contour edges of the plates and that thereby a bellows shall be formed.

The plates stiffening the sail segments are divided into a rear part and into a front part corresponding to the foil cap and are guided along vertical cables. Appropriately the profiled sail when seen in side view assumes an upwardly tapering contour and an end plate which is elliptical in top view may be mounted on the top sail beam to oppose flow detachment.

The description below of an illustrative embodiment of the invention will elucidate further features and advantages. The individual features of the claims may be embodied individually per se or in arbitrary combinations in other embodiments of the invention.

Figure 1:
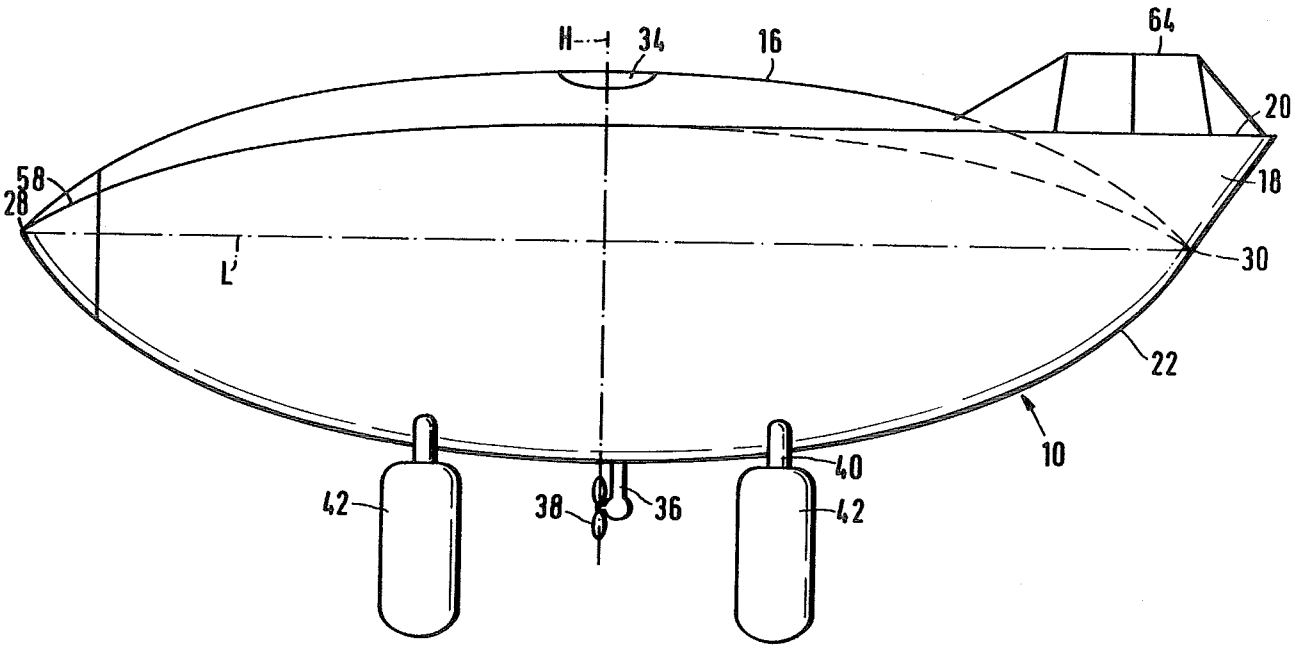
FIG. 1 is a schematic side view of a sailboat of the invention without a mast.
Figure 2:
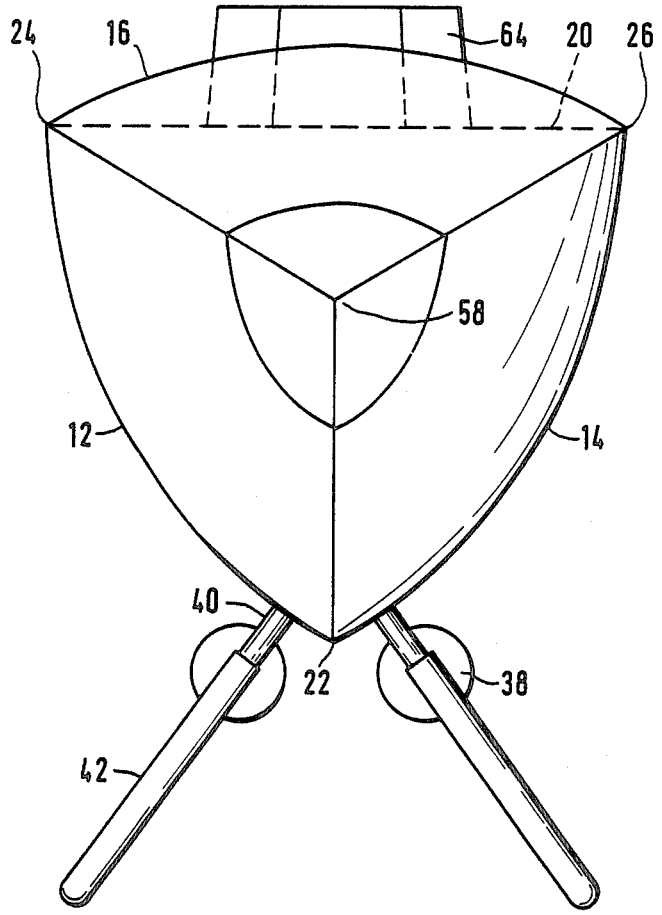
FIG. 2 is a schematic stern view of the sailboat of FIG. 1.

The hull 10 shown outlined in FIGS. 1 and 2 is created in that all hull cross-sections form upended, equilateral triangles with convexly curved sides. The two side walls 12, 14 converge at the keel line 22 extending between the bow 30 and the stern 28. The deck wall 16 may be curved convexly the way the side walls 12, 14 are and converges with the side wall 12 into an upper side edge 24 and with the side wall 14 into an upper side edge 26. Besides the positional stability induced by other factors of this cross-section, the latter also achieves high hull compressive strength. Moreover the boat thereby shall self-right in the event of capsizing.

The keel line 22 and the upper sides edges 24, 26 bound all the conceptual triangles which gradually diminish in size toward the bow and toward the stern until they become dot-sized, whereby they shall converge at the theoretical bow and stern points 28 and 30. The stern may be a transparent cockpit 58 while the bow may carry an integrated canopy. Because the triangles determining the hull contour decrease exponentially toward bow and stern, the hull seen in side or top view assumes the approximate shape of an ellipse which enhances the rigidity.

If the deck 16 Corresponds to the upwardly convex triangle side 16 of FIG. 2 when its symmetry is rigorously observed, the deck receives an extension 18 at the bow to improve travel properties in such a manner that generally the upper side 20 of the extension is plane and as shown in FIG. 1 will tangentially merge into the upper hull side edges 24, 26. The keel edge 22 extends beyond the theoretical bow point 30 as far as the bow tip of the extension 18 at the upper side of which begins a canopy 64 giving an all-round view to the pilot.

At its center and around the continuation indicated in FIG. 1 of the short semi-axis H, the deck 16 comprises an opening 34 to receive a mast 60 (FIGS. 3, 4) of triangular cross-section and having a large resting length in the hull between the deck and the keel. Due to this great rest length between a support mounted near the keel line in the hull and the passage in the deck 16, there is no need to brace the mast. Because of its nut- or egg-shape, the hull cross-section is suitable to absorb all forces introduced by the mast and to transmit them. The edged mast therefore can transmit the forces applied to it by a rotary drive when the sail is deployed to the beams and furthermore it can transmit the wind's propelling forces on the sail to the hull in the proper direction.

Figure 3:
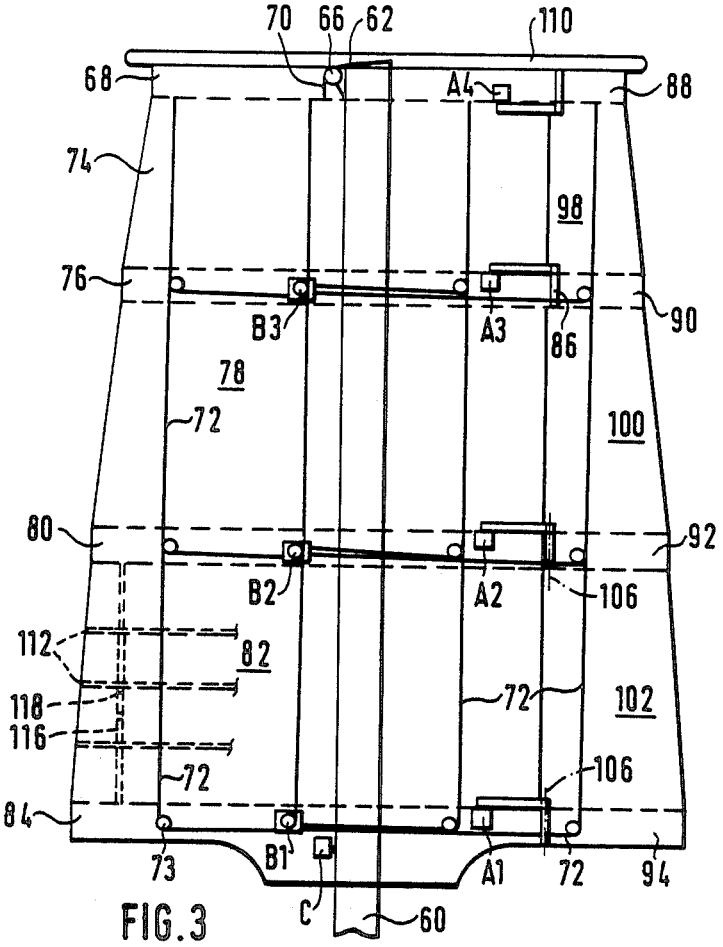
FIG. 3 is a schematic side view of the mast with pulled-up profiled sail for the sailboat of FIG. 1.
Figure 4:
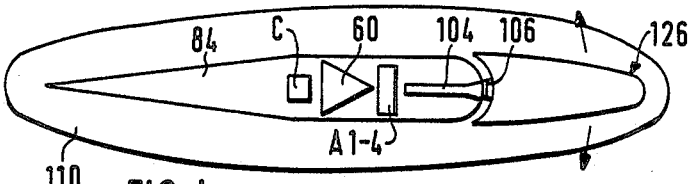
FIG. 4 is a schematic cross-section of the profiled sail.

The mast 60 belongs to a profiled sail which as shown in FIG. 3 assumes an upwardly tapering contour and which according to FIG. 4 corresponds to an approximately symmetrical airfoil contour. Several horizontal sail beams are kept in vertically displaceable manner on the mast 60, namely a top beam 68, an upper intermediate beam 76, a lower intermediate beam 80 and a deck beam 84. These beams consist of intrinsically ridigified frames illustratively made of lightweight metals and of which the contours are matched to the airfoil and within which are housed deflection rollers, cables and winch motors so that when reefing, two adjacent beams can be moved relatively to each other, the entire system being displaceable up and down along the mast in both the reefed and the deployed states.

One or more deflecting rollers 66 are housed in an upper mount 62 of the sail mast whereby using a cable 70 the top beam 68 and the entire sail will be pulled up. The cable 70 is driven by a lower winch motor C housed within the illustratively trough-shaped deck beam 84. The deck beam 84 is mounted at the level of the deck 16 to the mast 60 and for reefed sail will then support all sail superposed sail beams. When starting from this condition the sail is deployed, the motor winch C first pulls up the top beam into any desired height and depending on the desired total sail height one or more intermediate sails—for instance the upper sail segment 74—will be set between the top beam 68 and the upper intermediate beam 76. The moment in the process of pulling up the sail the upper most sail segment 74 is taut, the next sail segment 78 will be pulled up due to the upper intermediate beam 76 being carried along. The number of sail beams and sail segments is arbitrary.

Each beam is connected by at least one cable and one winch to the next higher beam to reef the sail segment above it. Only the cable means 72 to reef the lower sail segment 82 is shown in FIG. 3 among these connections, where this sail segment 82 extends in taut manner between the deck beam 84 and the lower intermediate beam 80. The cables 72 acting on the intermediate beam 80 are made to move over deflection rollers in the deck beam 84 by a motor winch B1 reefing the intermediate beam 80 and all other upper sail beams and sail segments at the mast 60 by one step until the intermediate beam 80 comes to rest on the deck beam 84. A synchronizer assures that when the motor winch B1 is turned on simultaneously the cable means 70 engaging the top beam 68 and actuated by the winch C shall be made adequately slack by slowing or engaging the winch C.

As shown in FIG. 3, the front end of the profiled sail consists of a hinging airfoil cap 94 which is adjustable in the vicinity of each beam and sail segment by independent drive means to change the airfoil cross-section so as to match the particular sailing manoeuvers. A foil cap 88 is linked by hinges 86 to the front end of the top beam 68 and has a contour similar to that shown in FIG. 4. Front cap segments 90, 92 and 94 are linked also by means of suitable hinges and articulations to the intermediate beams 76, 80 and to the deck beam 84 respectively and just as do the rear beam segments, they also consist of frames and have separate sail coverings 98, 100 and 102 respectively which in reefing collapse in the manner of an accordion.

As shown in FIG. 4, the front cap segment always is provided with a pivot arm 104 entering the rearward beam segment which thereby can be pivoted about a vertical shaft 106 mounted to the front side of the main beam frame. A drive motor A1 . . . A4 is coupled each to the pivot arm 104 to pivot the particular cap segment. Obviously the control may be such that the pivot drives A1 . . . A4 are actuated jointly and in the same direction.

In addition, though omitted from the drawing, a pivoting fin may be provided at the end of the sail to displace the airfoil cross-section and to tack into the wind at the most advantageous efficiency. Again omitted from the drawing is an embodiment wherein two or more profiled sails of the kind shown in FIG. 3 are mounted one behind the other on the hull which may be straight over a central segment.

FIG. 3 further shows that the profiled sail as seen in side view presents an upwardly tapering contour and that the top beam 68 is equipped at its upper side with an end plate 110 having an approximately elliptical contour as shown by FIG. 4.

Figure 5:
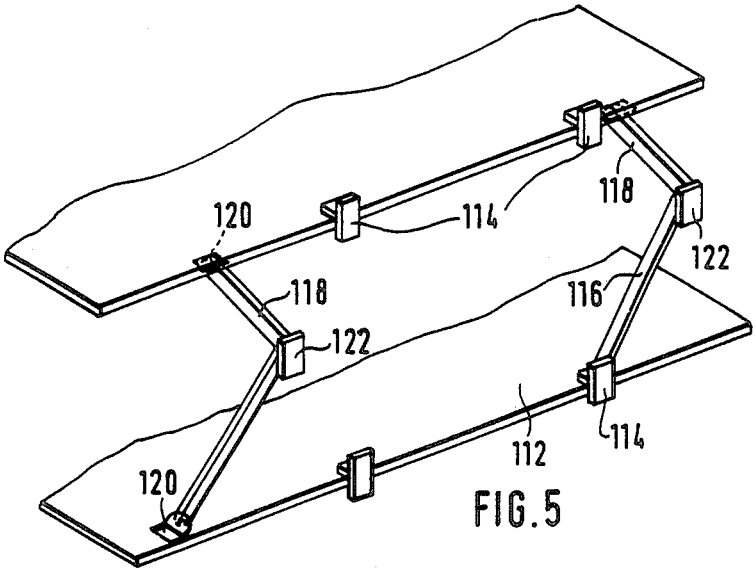
FIG. 5 is a schematic partial perspective of two adjacent sail stiffening plates.

To make the sail segments mounted on the periphery of the beams stiffer, and as furthermore substantial cavities are present in part between them, stiffener plates 112 are provided, shown in part in FIG. 3, which may correspond to the airfoil contour and illustratively be made of plastic. As shown in FIG. 5 arbitrary suitable fittings 114 are cemented or riveted onto the edges of the plates 112 so that the sail can be fixed to them in appropriate manner. The stiffening plates 112 are mutually apart in the pulled-up state of the sail by a distance relating to the sail size, for instance 30 to 50 cm, and are connected to each other or to the beam below or above by pairs of toggle-joints 116, 118 projecting outwardly along the plate periphery. The vertical length of the stretched sail segment in the area between two adjacent stiffening plates 112 furthermore is so sized that the pairs of toggle-joints 116, 118 shall be slanting outwardly even in this state, as shown by FIG. 5. The hinge points 120 of the toggle-joints 116, 118 at the plates 112 are located inward from the peripheral edge of the plate, and the knees 122 of the pairs of toggle-joints are equipped with a connection means 122 suitable to secure a solid connection with the sail cloth. Obviously the pairs of toggle-joints also are provided between a beam and the adjacent stiffening plate 112. Using the described tautening and folding system, the profiled sail once in the reefed condition thereafter can automatically fold in the manner of an accordion or bellows.

Similar to the case of the sail beams, the stiffening plates 112 are organized into rear parts and front parts corresponding to the foil cap and are guided each by at least two vertical cables extending between adjacent beams.

Figure 6:
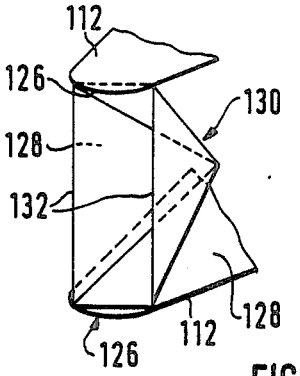
FIG. 6 is a schematic perspective of the front segment of the profiled sail.

In order that the sail cloth also can be properly folded at the front end of the airfoil cap, it may be called for to cover the airfoil cap on the side with two pieces of sail 128 which leave clear the front and much curved area 126. To close off the sail in this strongly curved area, and also to make it foldable, the spacings between adjacent stiffening plates 112 or sail beams are sealed by front, bag-like sail segments 130 as shown in FIG. 6, which are connected to the front side edges of the pieces of sail cloth or with the upper and the lower sides of the plates 112 limiting the aperture segment.

To achieve better maneuverability of the sailboat, the hull may be equipped in front of and behind its center with a total of four downward and outward rudders 42 arranged as shown in FIGS. 1 and 2. Ship screws 38 acting as auxiliary drives can be mounted between the front and rear pairs of rudders.

The main rudder vanes 42 are mounted on rudder shafts 40 of which the extensions are made to pass inside the hull 10 where they are supported and are displaced by omitted drive means, for instance hydraulic cylinders driving the crank-levers of the shafts. Outside the hull 10, the rudder shafts 40 are equipped with a hydrodynamic lining 46.

Because the rudders of the front and rear pair of rudders are mounted symmetrically relative to the hull keel edge 22 and mutually subtend an acute angle of about 60°, the rudders equipped with lower end plates are suitable a rest legs so that the boat can be set up on flat ground.

I claim:

1. A sailboat, comprising:

(a) a generally closed hull having a deck;

(b) a sail including at least one mast adjustably mounted on said hull;

(c) said mast forming a central part of said sail and having an edged cross-section;

(d) a plurality of generally horizontal said beams cooperating with said mast and being vertically displaceable relative thereto;

(e) said sail beams being interconnected by individual sail segments;

(f) each said segment being adapted to be reefed in the form of bellows between adjacent sail beams;

(g) each said sail segment being displaceable to assume a deployed position;

(h) said sail having a symmetrical airfoil contour top and including a laterally adjustable airfoil cap about the front thereof;

(i) said mast including a polygonal pipe means;

(j) said deck including a seat for rotatably mounting said pipe means therein; and (k) said sail beams being individually connected to the next higher sail beam by at least one cable means and at least one winch motor means.

2. The sailboat of claim 1, wherein:

(a) said pipe means is triangular in shape.

3. The sailboat of claim 1, wherein:

(a) at least one of said sail beams is formed of a metal; and (b) one of said sail beams being displaceable to a topmost position by its respective cable means such that the other of said sail beams individually suspend from a respective upper sail beam by a corresponding sail segment.

4. The sailboat of claim 1, wherein:

(a) each said sail beam together with its respective sail segment forms a symmetrical airfoil profile;

(b) each said sail beam including a front portion and a rear portion; and (c) an airfoil cap adjustably mounted adjacent each said front portion.

5. The sailboat of claim 4, wherein:

(a) each said airfoil cap including a portion pivotable about a central, vertical axis.

6. The sailboat of claim 5, wherein:

(a) each said sail segment comprises a first sail portion fastened to the rear portion of two adjacent sail beams and a second sail portion enclosing the respective airfoil cap.

7. The sailboat of claim 1, wherein:

(a) one of said sail beams is trough-shaped.

8. The sailboat of claim 7, wherein:

(a) said trough-shaped sail beam is the lowermost sail beam and has an upperside and an underside; and (b) said underside having a rounded configuration for covering said seat when said mast is positioned on said hull.

9. The sailboat of claim 1, wherein:

(a) said sail segments are hollow; and (b) a plurality of stiffening plates are positioned between individual sail beams within the respective sail segment.

10. The sailboat of claim 9, wherein:

(a) said plates are connected to one another by outwardly projecting toggle-joints having knees in a manner such that a portion of said sail segment fastened to the knees of said toggle-joints is displaced outwardly relative to another portion of said sail segment mounted to the edges of said plates.

11. The sailboat of claim 9, wherein:

(a) said plates are connected to an adjacent sail beam by outwardly projecting toggle-joints having knees in a manner such that a portion of said sail segment fastened to the knees of said toggle-joints is displaced outwardly relative to another portion of said sail segment mounted to the edges of said plates.

12. The sailboat of claim 9, wherein:

(a) said plates are organized into a front section and a rear section; and (b) each of said front and rear sections is guided by at least two vertical cables extending through adjacent sail beams.

13. The sailboat of claim 9, wherein:

(a) a plurality of toggle-joints having knees are mounted on the upper and lower sides of at least one of said plates.

14. The sailboat of claim 13, wherein:

(a) said toggle-joints are located inwardly of the peripheral edge of said plate and slant outwardly as far as the toggle-joint knee.

15. The sailboat of claim 1, further comprising:

(a) an elliptical end plate mounted stop one of said sail beams; and (b) said one of said sail beams being the topmost sail beam.

16. The sailboat of claim 1, wherein:

(a) said sail is contoured to taper upwardly.

17. The sailboat of claim 1, wherein:

(a) said hull is generally elliptical in shape.

18. The sailboat of claim 17, wherein:

(a) said hull includes a stern and a bow positioned generally opposite to said stern; and (b) said hull is extended at said bow by a cockpit having a generally planar upper side.

* * * * *